US009266380B2

(12) United States Patent
Wang et al.

(10) Patent No.: US 9,266,380 B2
(45) Date of Patent: Feb. 23, 2016

(54) WRITING INSTRUMENT HAVING AN INK BALANCE MECHANISM

(71) Applicants: Ningbo Wuyun Pen Manufacturing Co., Ltd., Yuyao, Zhejiang (CN); Microporous Technology (Ningbo) Limited, Yuyao, Zhejiang (CN)

(72) Inventors: Liping Wang, Yuyao (CN); Yang Wen, Yuyao (CN)

(73) Assignees: NINGBO WUYUN PEN MANUFACTURING CO., LTD., Yuyao (CN); MICROPOROUS TECHNOLOGY (NINGBO) LIMITED, Yuyao (CN)

( * ) Notice: Subject to any disclaimer, the term of this patent is extended or adjusted under 35 U.S.C. 154(b) by 0 days.

(21) Appl. No.: 14/149,804

(22) Filed: Jan. 7, 2014

(65) Prior Publication Data

US 2015/0063894 A1 Mar. 5, 2015

(30) Foreign Application Priority Data

Sep. 3, 2013 (CN) ..... 2013 1 0398639

(51) Int. Cl.

| | |
|---|---|
| ***B43K 8/08*** | (2006.01) |
| ***B43K 8/02*** | (2006.01) |
| ***B43K 8/03*** | (2006.01) |
| ***B43K 8/04*** | (2006.01) |

(52) U.S. Cl.

CPC ... *B43K 8/02* (2013.01); *B43K 8/03* (2013.01); *B43K 8/04* (2013.01); *B43K 8/08* (2013.01)

(58) Field of Classification Search

CPC ..... B43K 8/08
USPC ..... 401/198, 199
See application file for complete search history.

(56) References Cited

U.S. PATENT DOCUMENTS

| | | | | |
|---|---|---|---|---|
| 6,227,741 | B1 * | 5/2001 | Quercioli | 401/199 |
| 6,695,517 | B2 * | 2/2004 | Witz et al. | 401/198 |
| 7,578,631 | B2 * | 8/2009 | Kurita et al. | 401/198 |
| 8,591,132 | B2 * | 11/2013 | Hui | 401/199 |
| 2001/0016141 | A1 * | 8/2001 | Kaufmann | 401/198 |
| 2007/0212159 | A1 * | 9/2007 | Kurita et al. | 401/199 |
| 2013/0004231 | A1 * | 1/2013 | Nakatani et al. | 401/198 |

* cited by examiner

*Primary Examiner* — David Walczak
*Assistant Examiner* — Joshua Wiljanen

(57) ABSTRACT

A writing instrument is provided with a barrel including a bottom opening; a partition disposed in the barrel to divide the barrel into an upper ink reservoir filled with ink and a lower storage filled with an absorbent material; a writing member partially disposed in the absorbent material and extending out of the bottom opening; and a conveying line disposed through the partition. The conveying line includes a venting channel and an ink conveying channel. Each of the venting channel and the ink conveying channel communicate with both the ink and the absorbent material. A smooth writing can be carried out.

11 Claims, 8 Drawing Sheets

WRITING INSTRUMENT HAVING AN INK BALANCE MECHANISM

BACKGROUND OF THE INVENTION

1. Field of the Invention

The invention relates to writing instruments and more particularly to a writing instrument comprising a mechanism including a venting channel and an ink conveying channel for reaching a balance between ink in an ink reservoir and ink in an absorbent material, thereby facilitating writing.

2. Description of Related Art

Conventional writing instruments such as marker pens and highlighters have a porous tip of fibrous material for containing the ink supply (i.e., filler-type writing instrument). However, a number of drawbacks have been found in the filler-type writing instruments as detailed below. Ink flow will gradually decrease with the written characters became blurry as writing time increase. Further, there is at least 30% ink remained in the filler when the writing instrument is useless (i.e., waste).

There have been numerous prior writing instruments. For example, Japan Laid-open Patent Publication No. 2534821 discloses a writing instrument comprising an ink supply mechanism capable of mixing air and ink. However, it is disadvantageous due to complicated components, high precision requirements, and high manufacturing cost.

China Patent Publication Numbers CN1749029A and CN101032905A both disclose a writing instrument comprising a plurality of interconnected ink tubes. However, how to accommodate the ink tubes in a small interior of the writing instrument is always an issue to be solved.

U.S. Publication No. US20030068191A1 discloses a writing instrument comprising a plurality of small ink chambers in the axis direction for conveying ink to a writing element. However, it has complicated components and there is no venting mechanism. Unfortunately, its ink flow may be interrupted when writing is quick.

Notwithstanding the prior art, the invention is neither taught nor rendered obvious thereby.

SUMMARY OF THE INVENTION

The invention aims at eliminating drawbacks associated with prior art writing instruments by providing a writing instrument having the characteristics of leak proof, smooth writing, being adapted to large, medium, or small barrel of the writing instrument, and having simple components for mass production.

It is therefore one object of the invention to provide a writing instrument comprising a barrel comprising a bottom opening; a partition disposed in the barrel to divide the barrel into an upper ink reservoir filled with ink and a lower storage filled with an absorbent material; a writing member partially disposed in the absorbent material and extending out of the bottom opening; and a conveying line disposed through the partition; wherein the conveying line comprises a venting channel and an ink conveying channel formed integrally with the venting channel; and wherein each of the venting channel and the ink conveying channel communicate with both the ink and the absorbent material.

Preferably, further comprises a capillary conveying wick disposed in the ink conveying channel.

Preferably, the capillary conveying wick further extends into the absorbent material to be in proximity to or in contact with the writing member.

Preferably, both the venting channel and the ink conveying channel are disposed through the partition.

Preferably, the venting channel comprises at least one sub-channel disposed through the partition.

Preferably, the ink conveying channel comprises at least one sub-channel disposed through the partition.

Preferably, the ink conveying channel has a length equal to or greater than a length of the venting channel.

Preferably, the venting channel comprises at least one sub-channel disposed through the partition.

Preferably, the ink conveying channel comprises at least one sub-channel disposed through the partition.

By utilizing the invention, the following advantages are obtained: The absorbent material is always infused by the ink supplied from the ink reservoir via the conveying line. Sufficient ink can flow from the absorbent material to the writing member for writing. In comparison with the conventional writing instruments, the invention has the characteristics of leak proof, smooth writing, being adapted to large, medium, or small barrel of the writing instrument, and having simple components for mass production.

The above and other objects, features and advantages of the invention will become apparent from the following detailed description taken with the accompanying drawings.

DETAILED DESCRIPTION OF THE INVENTION

Figure 1:
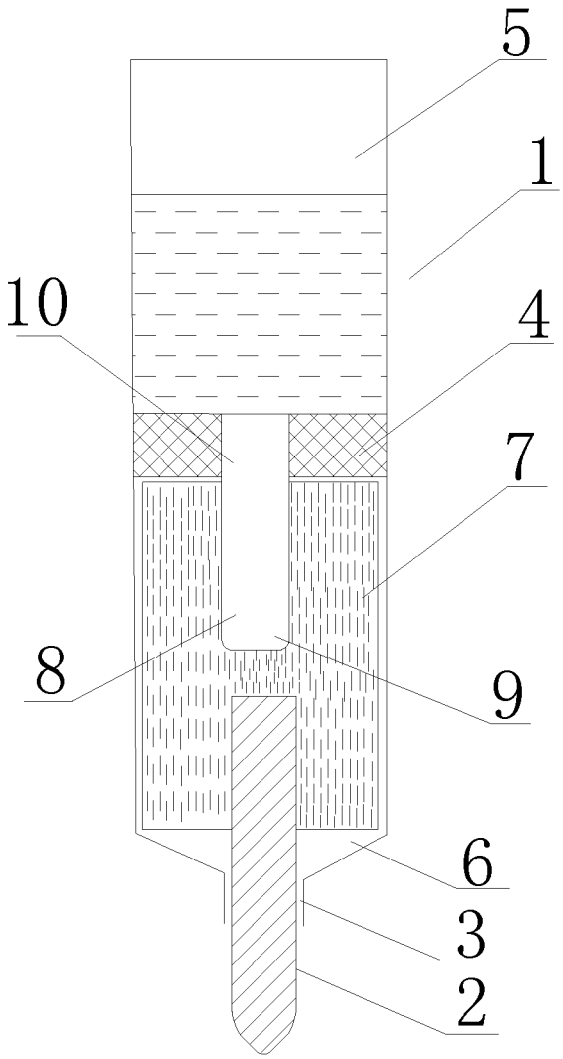
FIG. 1 is a longitudinal sectional view of a writing instrument according to a first preferred embodiment of the invention.
Figure 1A:
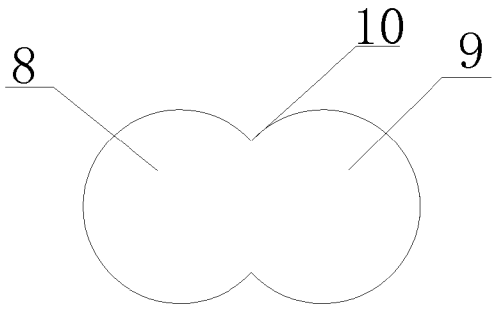
FIG. 1A is a top view of the conveying line shown in FIG. 1.

Referring to FIGS. 1 and 1A, a writing instrument in accordance with a first preferred embodiment of the invention comprises the following components as discussed in detail below.

A barrel 1 has a bottom opening 3. An elongated writing member 2 has a portion disposed in the barrel 1 and the remaining portion projecting out of the bottom opening 3. A partition 4 is disposed in the barrel 1 to divide an interior of the barrel 1 into an upper ink reservoir 5 and a lower storage 6 filled with an absorbent material 7. A rear portion of the writing member 2 is disposed in the storage 6. A conveying line 10 has a portion disposed through the partition 4 to communicate with ink stored in the ink reservoir 5 and the remaining portion disposed in the storage 6. A venting channel 8 and an ink conveying channel 9 are formed integrally in the conveying line 10 and are partially disposed in the absorbent material 7. A plurality of ribs (not shown) are formed on an inner surface of the storage 6 contacting the absorbent material 7. The writing member 2 is secured by narrow bottom opening 3. The writing member 2 is spaced from the conveying line 10 by a distance of about 2-10 mm and is partially disposed in the absorbent material 7. The portion of the barrel 1 between the conveying line 10 and the writing member 2 communicates with the atmosphere. The absorbent material 7 is porous in nature and is adapted to allow ink to pass through and infuse. The absorbent material 7 can communicate with the atmosphere. The writing member 2 is at an axis direction of the barrel 1.

Initially, in an upright position ink in the ink reservoir 5 passes the conveying line 10 to enter the absorbent material 7 for infusion. And in turn, the ink flows to the writing member 2. In the mean time, a negative pressure is created in the ink reservoir 5. Further, air in the absorbent material 7 forms bubbles which move to the ink reservoir 5 via the conveying line 10. This is called air ink exchange. The air ink exchange process will continue until the ink in the absorbent material 7 is sufficient to contact an end of the conveying line 10 in the absorbent material 7. Thus, the conveying line 10 is blocked with both the venting channel 8 and the ink conveying channel 9 being deactivated. Also, ink will stop flowing from the ink reservoir 5 to the absorbent material 7 via the conveying line 10 when the negative pressure in the ink reservoir 5 increases to a predetermined value. That is, a balance between ink in the ink reservoir 5 and ink in the absorbent material 7 is reached. At this state, ink stored in the absorbent material 7 has not reached a saturation state.

In use, ink from the absorbent material 7 flows out of the writing member 2. As such, the ink in the absorbent material 7 decreases. The decrease will continue until both the venting channel 8 and the ink conveying channel 9 are no longer blocked by the ink (i.e., both the venting channel 8 and the ink conveying channel 9 being activated). Thereafter, air enters the ink reservoir 5 via the venting channel 8 and ink in the ink reservoir 5 begins to flow to the absorbent material 7 via the ink conveying channel 9. The ink in the absorbent material 7 increase and contacts an end of the conveying line 10 in the absorbent material 7 after a period of time. Thus, the conveying line 10 is blocked with both the venting channel 8 and the ink conveying channel 9 being deactivated. Thus, air is stopped from entering the ink reservoir 5 via the conveying line 10 and the ink is stopped from flowing to the absorbent material 7 via the conveying line 10. Above processes may repeat until ink stored in the ink reservoir 5 is fully drained.

Pressure in the ink reservoir 5 is higher than the atmospheric pressure when either the atmospheric pressure drops or temperature in the ink reservoir 5 increases. And in turn, a small quantity of ink may flow from the ink reservoir 5 to the absorbent material 7 via the conveying line 10. That is, the small quantity of ink is absorbed by the absorbent material 7. To the contrary, pressure in the ink reservoir 5 is lower than the atmospheric pressure when either the atmospheric pressure increases or temperature in the ink reservoir 5 drops. And in turn, a small quantity of ink may flow from the absorbent material 7 to the ink reservoir 5 via the conveying line 10. In the embodiment, the conveying line 10 is of a shape capable of escaping air and conveying ink. For example, as shown in FIG. 1A, the conveying line 10 has a cross section of two overlaid circles in which one circle represents the venting channel 8 and the other circle represents the ink conveying channel 9, i.e., being figure-eight shaped.

Figure 2:
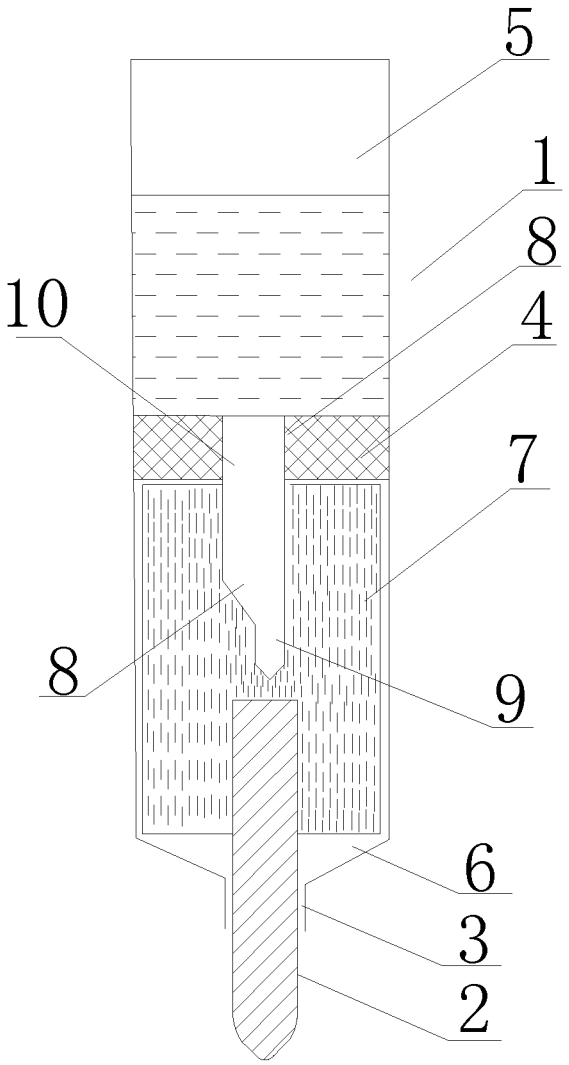
FIG. 2 is a longitudinal sectional view of a writing instrument according to a second preferred embodiment of the invention.
Figure 2A:
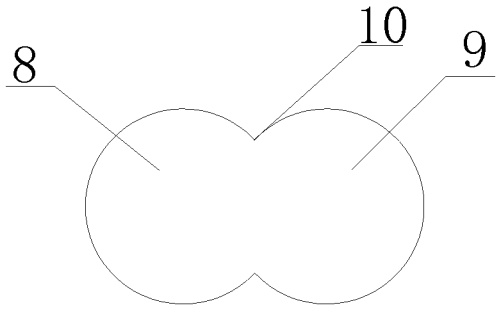
FIG. 2A is a top view of the conveying line shown in FIG. 2.

Referring to FIGS. 2 and 2A, a writing instrument in accordance with a second preferred embodiment of the invention is shown. The characteristics of the second preferred embodiment are substantially the same as that of the first preferred embodiment except the following: The length of the venting channel 8 in the absorbent material 7 is less than that of the ink conveying channel 9 in the absorbent material 7.

Figure 3:
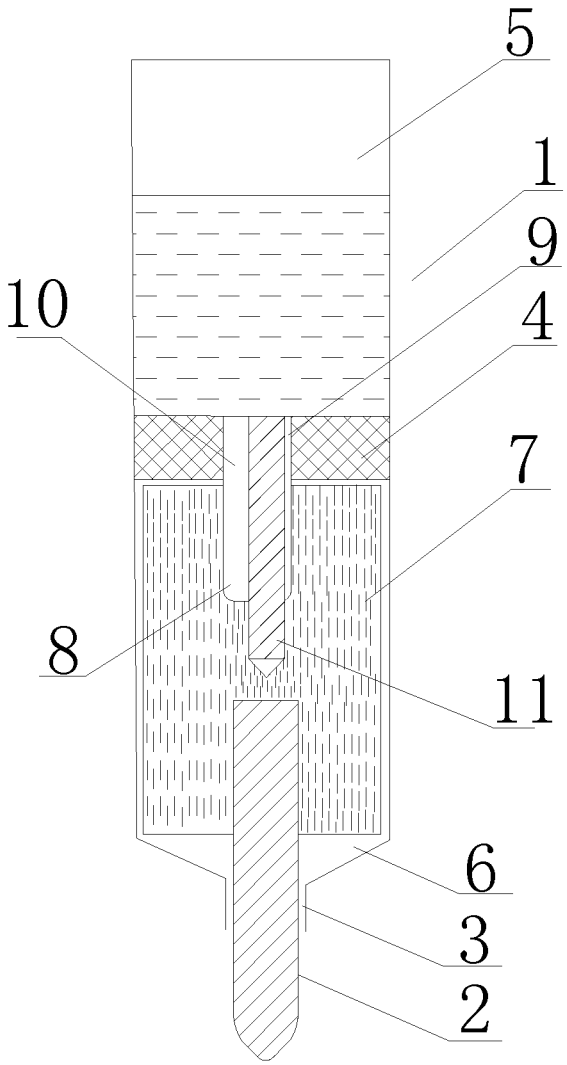
FIG. 3 is a longitudinal sectional view of a writing instrument according to a third preferred embodiment of the invention.
Figure 3A:
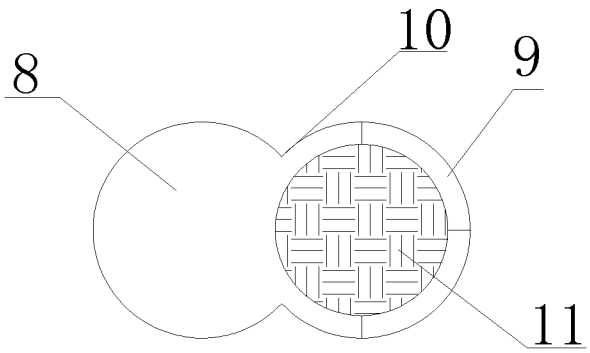
FIG. 3A is a top view of the conveying line shown in FIG. 3.

Referring to FIGS. 3 and 3A, a writing instrument in accordance with a third preferred embodiment of the invention is shown. The characteristics of the third preferred embodiment are substantially the same as that of the first preferred embodiment except the following: A capillary conveying wick 11 is inserted from an end of the conveying line 10 abutted the ink reservoir 5 through the ink conveying channel 9 (i.e., the conveying line 10) into the absorbent material 7 until being spaced from the writing member 2 by a distance of less than 2 mm. Ink in the ink reservoir 5 may flow from the capillary conveying wick 11 to the absorbent material 7 for infusion. And in turn, the ink flows to the writing member 2. In the mean time, a negative pressure is created in the ink reservoir 5. Further, air in the absorbent material 7 moves to the ink reservoir 5 via the venting channel 8. This is called air ink exchange. The air ink exchange process will continue until the ink in the absorbent material 7 is sufficient to contact an end of the venting channel 8 in the absorbent material 7. Thus, the venting channel 8 is blocked, i.e., the venting channel 8 being deactivated. Also, ink will stop flowing from the ink reservoir 5 to the absorbent material 7 via the conveying line 10 when the negative pressure in the ink reservoir 5 increases to a predetermined value. That is, a balance between ink in the ink reservoir 5 and ink in the absorbent material 7 is reached. At this state, ink stored in the absorbent material 7 has not reached a saturation state.

In use, ink from the absorbent material 7 flows out of the writing member 2. As such, the ink in the absorbent material 7 decreases. The decrease will continue until both the venting channel 8 and the capillary conveying wick 11 are no longer blocked by the ink (i.e., both the venting channel 8 and the capillary conveying wick 11 being activated). Thereafter, air enters the ink reservoir 5 via the venting channel 8 and ink in the ink reservoir 5 begins to flow to the absorbent material 7 via the capillary conveying wick 11. The ink in the absorbent material 7 increase and contacts an end of the conveying line 10 in the absorbent material 7 after a period of time. Thus, the conveying line 10 is blocked with both the venting channel 8 and the capillary conveying wick 11 being deactivated. Thus, air is stopped from entering the ink reservoir 5 via the venting channel 8 and the ink is stopped from flowing to the absorbent material 7 via the capillary conveying wick 11. Above processes may repeat until ink stored in the ink reservoir 5 is fully drained.

Pressure in the ink reservoir 5 is higher than the atmospheric pressure when either the atmospheric pressure drops or temperature in the ink reservoir 5 increases. And in turn, a small quantity of ink may flow from the ink reservoir 5 to the absorbent material 7 via the capillary conveying wick 11 due to capillary action. That is, the small quantity of ink is absorbed by the absorbent material 7. To the contrary, pressure in the ink reservoir 5 is lower than the atmospheric pressure when either the atmospheric pressure increases or temperature in the ink reservoir 5 drops. And in turn, a small quantity of ink may flow from the absorbent material 7 to the ink reservoir 5 via the capillary conveying wick 11 due to capillary action.

Figure 4:
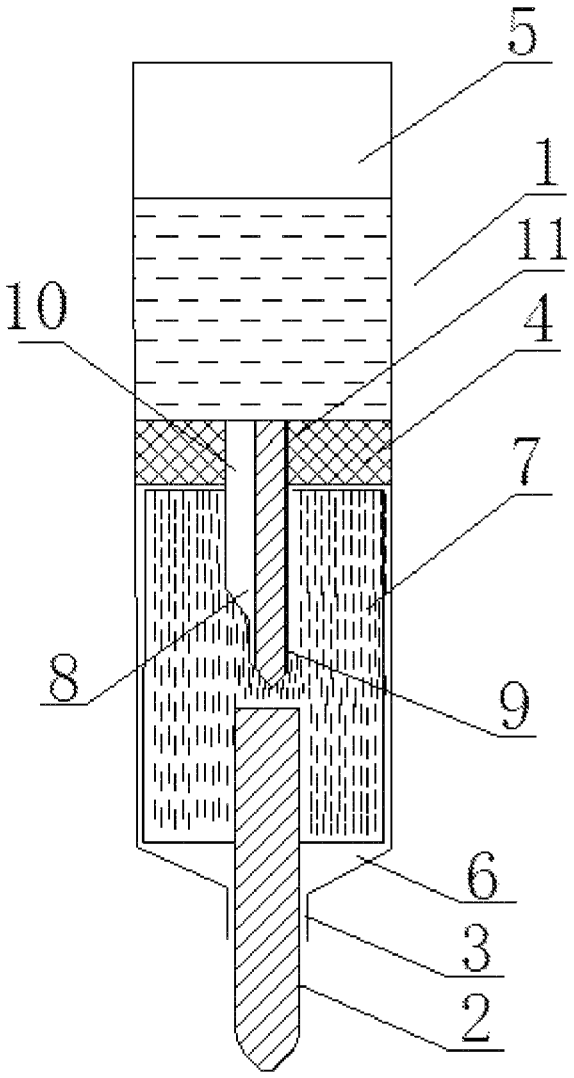
FIG. 4 is a longitudinal sectional view of a writing instrument according to a fourth preferred embodiment of the invention.
Figure 4A:
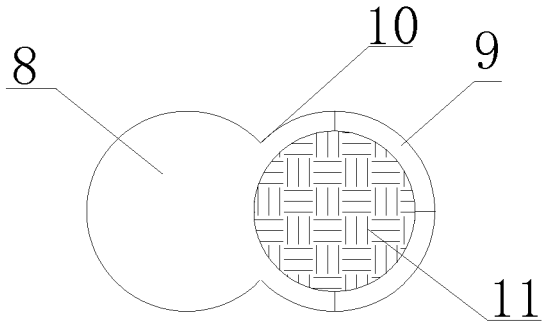
FIG. 4A is a top view of the conveying line shown in FIG. 4.

Referring to FIGS. 4 and 4A, a writing instrument in accordance with a fourth preferred embodiment of the invention is shown. The characteristics of the fourth preferred embodiment are substantially the same as that of the second and third preferred embodiments except the following: Regarding characteristic the same as the second preferred embodiment, the length of the venting channel 8 in the absorbent material 7 is less than that of the ink conveying channel 9 in the absorbent material 7. Regarding characteristic the same as the third preferred embodiment, the capillary conveying wick 11 is disposed through the ink conveying channel 9 into the absorbent material 7.

Figure 5:
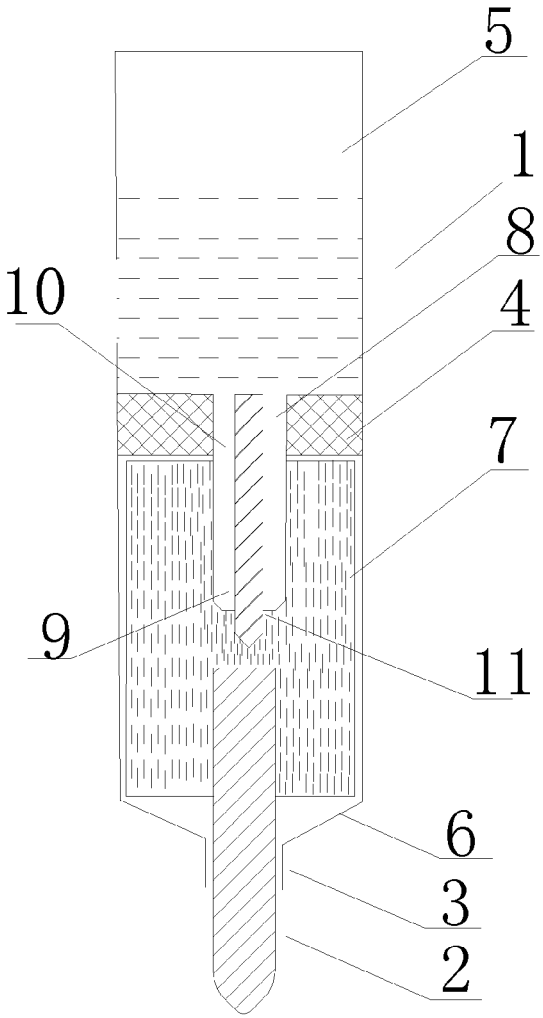
FIG. 5 is a longitudinal sectional view of a writing instrument according to a fifth preferred embodiment of the invention.
Figure 5A:
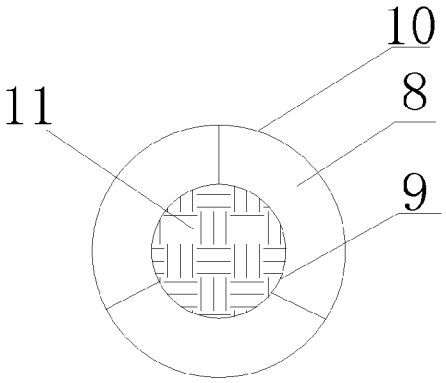
FIG. 5A is a top view of the conveying line shown in FIG. 5.

Referring to FIGS. 5 and 5A, a writing instrument in accordance with a fifth preferred embodiment of the invention is shown. The characteristics of the fifth preferred embodiment are substantially the same as that of the second and fourth preferred embodiments except the following: Cross section of the conveying line 10 is a circle, the ink conveying channel 9 has a cross section of circle and is disposed axially in the conveying line 10, and three equal venting channels 8 are provided on a periphery of the ink conveying channel 9. Ribs are provided on an inner surface of the ink conveying channel 9 for anchoring the capillary conveying wick 11. Regarding characteristic the same as the second preferred embodiment, the length of the venting channels 8 in the absorbent material 7 is less than that of the ink conveying channel 9 in the absorbent material 7. Regarding characteristic the same as the fourth preferred embodiment, the capillary conveying wick 11 is disposed through the ink conveying channel 9 into the absorbent material 7.

Figure 6:
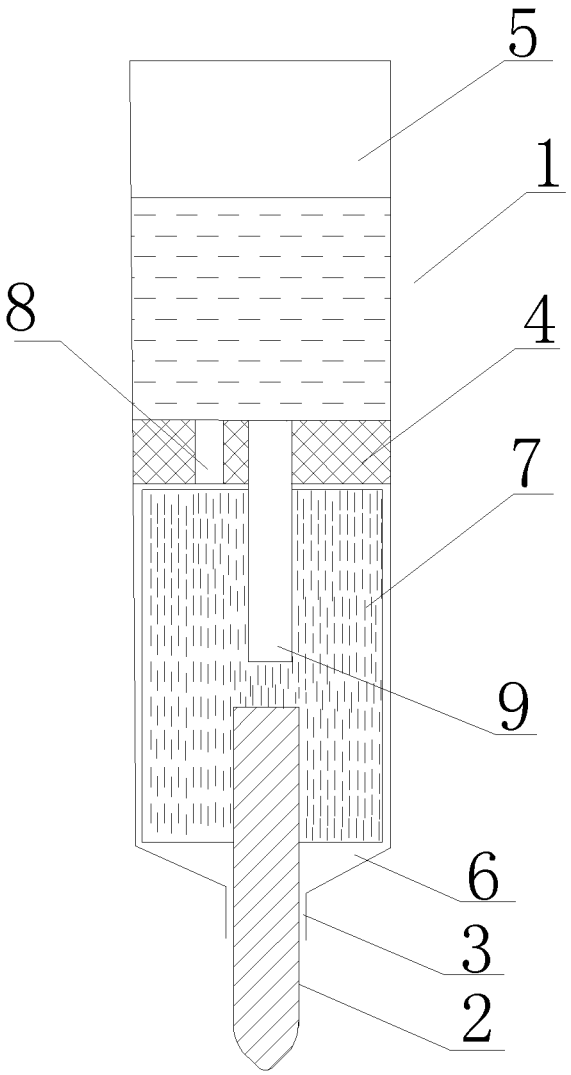
FIG. 6 is a longitudinal sectional view of a writing instrument according to a sixth referred embodiment of the invention.

Referring to FIG. 6, a writing instrument in accordance with a sixth preferred embodiment of the invention is shown. The characteristics of the sixth preferred embodiment are detailed below. It is particularly appropriate to writing instrument such as marker pen or high lighter having a narrow interior. It is understood that the venting channel and ink conveying channel described in above first to fifth preferred embodiments are difficult of being implemented in the sixth preferred embodiment because the narrow space of the barrel 1 is not capable of accommodating the relatively large venting channel and ink conveying channel. Thus, the conveying line is eliminated. One venting channel 8 is provided through the partition 4 to communicate with both the ink in the ink reservoir 5 and the absorbent material 7 in the storage 6. The ink conveying channel 9 extends from a bottom of the ink reservoir 5 through the partition 4 into the absorbent material 7. The venting channel 8 is blocked by ink. In an upright position ink in the ink reservoir 5 passes the ink conveying channel 9 to enter the absorbent material 7 for infusion. And in turn, the ink flows to the writing member 2. In the mean time, a negative pressure is created in the ink reservoir 5. Further, ink will stop flowing from the ink reservoir 5 to the absorbent material 7 via the ink conveying channel 9 when the negative pressure in the ink reservoir 5 increases to a predetermined value. That is, a balance between ink in the ink reservoir 5 and ink in the absorbent material 7 is reached. In use, ink from the absorbent material 7 flows out of the writing member 2. As such, the ink in the absorbent material 7 decreases. The decrease will continue until both the venting channel 8 and the ink conveying channel 9 are no longer blocked by the ink (i.e., both the venting channel 8 and the ink conveying channel 9 being activated). Thereafter, air enters the ink reservoir 5 via the venting channel 8 and ink in the ink reservoir 5 begins to flow to the absorbent material 7 via the ink conveying channel 9. The ink in the absorbent material 7 increases and contacts an end of the ink conveying channel 9 in the absorbent material 7 after a period of time. Thus, both the venting channel 8 and the ink conveying channel 9 are deactivated. Thus, air is stopped from entering the ink reservoir 5 via the venting channel 8.

Figure 7:
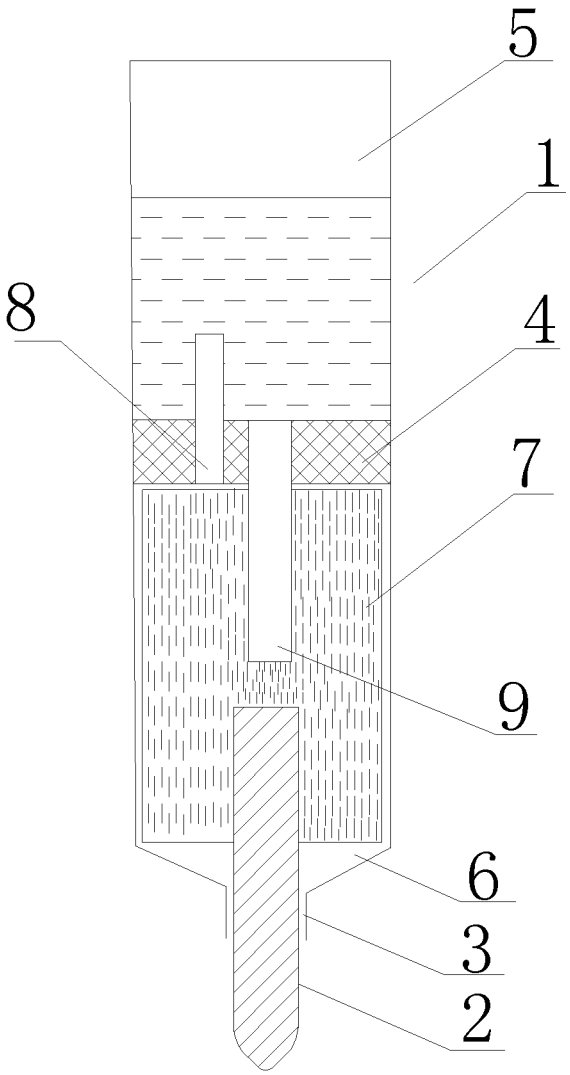
FIG. 7 is a longitudinal sectional view of a writing instrument according to a seventh preferred embodiment of the invention.

Referring to FIG. 7, a writing instrument in accordance with a seventh preferred embodiment of the invention is shown. The characteristics of the seventh preferred embodiment are substantially the same as that of the sixth preferred embodiment except the following: The venting channel 8 further extends into the ink reservoir 5.

Figure 8:
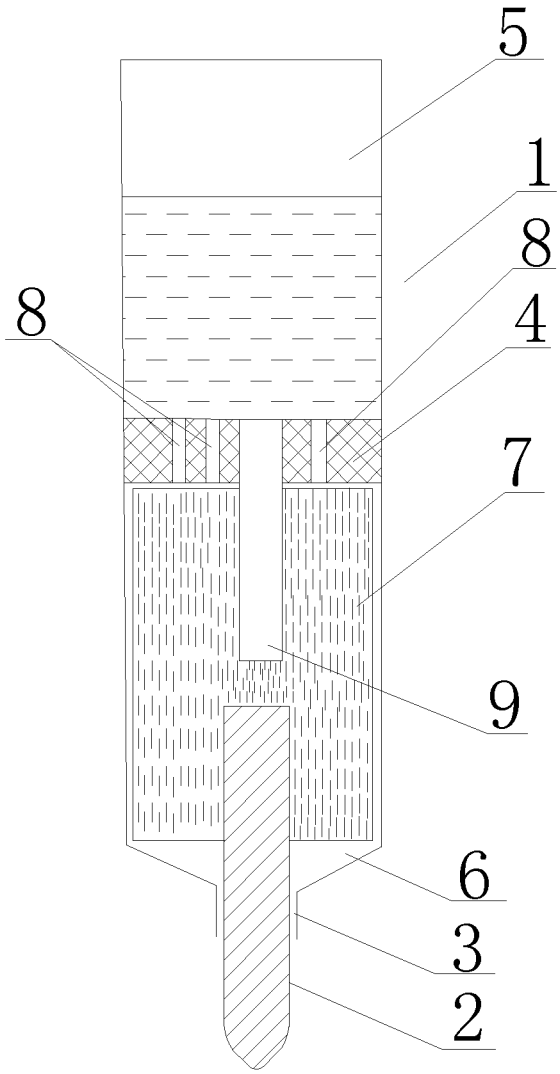
FIG. 8 is a longitudinal sectional view of a writing instrument according to an eighth preferred embodiment of the invention.

Referring to FIG. 8, a writing instrument in accordance with an eighth preferred embodiment of the invention is shown. The characteristics of the eighth preferred embodiment are substantially the same as that of the sixth preferred embodiment except the following: The sixth preferred embodiment is particularly appropriate to writing instruments having large ink consumption. Thus, there are three venting channels 8 provided through the partition 4.

The absorbent material 7 is made of a fibrous material, a porous material, a hook and loop material, etc. The absorbent material 7 is capable of carrying out a capillary action for allowing ink to pass through and infuse. The absorbent material 7 can be enclosed by a porous sheath or not.

Although the invention has been described in detail, it is to be understood that this is done by way of illustration only and is not to be taken by way of limitation. The scope of the invention is to be limited only by the appended claims.

What is claimed is:

1. A writing instrument comprising:

a barrel comprising a bottom opening;

a partition disposed in the barrel to divide the barrel into an upper ink reservoir filled with ink and a lower storage filled with an absorbent material;

a writing member partially disposed in the absorbent material and extending out of the bottom opening; and a conveying line disposed through the partition and a first end communicating with the ink and second end communicating with the absorbent material, wherein the conveying line is composed of at least one venting channel and an ink conveying channel, an upper end of the at least one venting channel is flush with that of the ink conveying channel and partition, and the at least one venting channel is shorter than the ink conveying channel in height.

2. The writing instrument of claim 1, wherein the at least one venting channel is one in number.

3. The writing instrument of claim 2, wherein the venting channel axially connects with and direct communicates with the ink conveying channel.

4. The writing instrument of claim 3, wherein a capillary conveying wick is inserted into the ink conveying channel.

5. The writing instrument of claim 4, wherein the capillary conveying wick is less than the ink conveying channel in diameter.

6. The writing instrument of claim 4, wherein the venting channel is greater than the ink conveying channel with the capillary conveying wick in diameter.

7. The writing instrument of claim 6, wherein the ink conveying channel with the capillary conveying wick is axially placed at a center of the venting channel.

8. The writing instrument of claim 7, wherein at least two ribs are provided on an inner surface of the ink conveying channel for dividing the capillary conveying wick into at least two segments.

9. The writing instrument of claim 1, wherein the at least one venting channel is two or more in number.

10. The writing instrument of claim 9, wherein the two or more venting channels are completely within the partition without any protrusion.

11. The writing instrument of claim 10, wherein each of the two or more venting channels is less than the ink conveying channel in diameter.

* * * * *